US005257434A

United States Patent [19]

Nabetani

[11] Patent Number: 5,257,434

[45] Date of Patent: Nov. 2, 1993

[54] TOOTHBRUSH

[75] Inventor: Takashi Nabetani, Osaka, Japan

[73] Assignee: Sunstar Kabushiki Kaisha, Osaka, Japan

[21] Appl. No.: 420,701

[22] Filed: Oct. 11, 1989

Related U.S. Application Data

[63] Continuation of Ser. No. 131,683, Dec. 11, 1987, abandoned.

[30] Foreign Application Priority Data

Dec. 11, 1986 [JP] Japan ..... 61-296202

[51] Int. Cl.[5] ..... A46B 9/04

[52] U.S. Cl. ..... 15/167.1

[58] Field of Search ..... 15/159 A, 167.1, 167.2, 15/191 R, 195, 110

[56] References Cited

U.S. PATENT DOCUMENTS

| | | | |
|---|---|---|---|
| 560,663 | 5/1896 | Wallas | 15/167.1 |
| 1,346,536 | 7/1920 | Fitz-Gibbon | 15/167.1 |
| 1,468,888 | 9/1923 | Stuart . | |
| 1,916,641 | 7/1933 | Seelinger | 15/167.1 |
| 2,004,633 | 6/1935 | Miller | 15/167.1 |
| 2,097,987 | 11/1937 | Phillips | 15/167.1 |
| 2,244,615 | 6/1941 | Garcin | 15/167.2 |
| 3,100,309 | 8/1963 | Gambino | 15/167.1 |
| 4,570,282 | 2/1986 | Kaufman et al. | 15/167.1 |

FOREIGN PATENT DOCUMENTS

| | | | |
|---|---|---|---|
| 422343 | 3/1911 | France | 15/167.1 |
| 657673 | 5/1929 | France | 15/167.1 |
| 2440171 | 10/1979 | France . | |
| 2502918 | 10/1982 | France | 15/167.1 |
| 324623 | 11/1957 | Switzerland | 15/167.1 |
| 0000745 | of 1886 | United Kingdom | 15/167.2 |
| 444382 | 3/1936 | United Kingdom . | |

*Primary Examiner*—Harvey C. Hornsby
*Assistant Examiner*—Mark Spisich
*Attorney, Agent, or Firm*—Sughrue, Mion, Zinn, Macpeak & Seas

[57] ABSTRACT

A toothbrush comprising a block head having bristle tufts implanted therein, at least the whole of bristle tufts outer circumferentially disposed being implanted so as to be inwardly slanted in the direction substantially toward a center of the block head.

6 Claims, 2 Drawing Sheets

TOOTHBRUSH

This is a continuation of application No. 07/131,683 filed Dec. 11, 1987, abandoned.

BACKGROUND OF THE INVENTION

The present invention relates to a toothbrush which can effectively remove dental plaque or foreign matters deposited on teeth without hurting gingiva or gums.

Recently, it has been elucidated that both the two most significant dental diseases, dental caries and periodontosis, are caused by dental plaque. Accordingly, in order to protect teeth against such diseases, it has been found that it is preferable to carry out a brushing method, such as a scrubbing method, a Fones' method, or a Bass method, by which dental plaque can be effectively removed by utilizing the tip ends of bristle tufts of a toothbrush. Since the tip ends of bristle tufts are made into contact with the gums while giving a considerably strong pressing force against the gums in such a brushing method as described above, relatively soft or fine bristles are implanted in a block head (tuft-implant portion) of a conventional toothbrush developed for the purpose of use for carrying out the above-mentioned brushing method so as to prevent the gums from being hurt.

Recently, as a result of studies in which a pressure sensor was disposed on a teeth surface so as to investigate the correlation among the diameter of bristles of a toothbrush, the brushing pressure, and the dental plaque removing effect, it was found that the thicker the bristles, the stronger the brushing pressure and the more superior the dental plaque removing effect as described, e.g., in *J. Japan. Ass. Periodont.*, Vol. 28, pages 1,120 to 1,130 (1986). Accordingly, it has been found that it is preferred to make the diameter of the bristles to increase the brushing pressure in view of the purpose of the dental plaque removing. On the other hand, however, there is also a fact that the use of fine bristles are preferable in order to prevent gums from being hurt. These two facts have a relationship of antinomy to each other.

As a means for solving such an antinomy, it can be considered to provide a method in which the brushing pressure is made high by making the bristle tuft-implantation density high while using fine bristles. However, in order to realize this method, it is necessary to make tuft holes formed in a block head large in diameter, or to make the density of the tuft holes high. There is a problem that the touch of bristle tufts becomes hard so as to make the feeling of use poor when the tuft holes are enlarged in diameter, while there is another problem that the block head is apt to be broken due to mechanical fatigue or a chemical action when the density of the tuft holes is made high. In either case, there is still another problem that water is hardly drained to cause an insanitary state after use of a toothbrush because the intervals between the tuft holes are narrow. In order to solve the foregoing problems, the present inventor has thought of an idea to make bristle tufts slant.

Conventionally, the slanting arrangement of bristle tufts per se is known as disclosed e.g., in Japanese Utility Model Publication No. 31095/79 and Japanese Utility Model Application (OPI) Nos. 121765/74 and 3972/72 (the term "OPI" used herein means a "published unexamined Japanese Patent or Utility Model Application"), U.S. Pat. Nos. 3,722,020, 4,010,509, 4,051,571, 4,081,876, 4,115,894, 4,137,593, 4,291,431, 4,382,309, and 4,493,125. In these prior arts, the slanting arrangement is employed, e.g., in order to brash effectively the difficult tooth area such as the lingual of the lower teeth, etc.; in order to clean the gap of the teeth; in order to aid brushing by the rolling method; or the like. These prior arts, however, have not been directed to make the brushing pressure high, and therefore the arrangement is not suitable for making the brushing pressure high. As the result of investigation on the position as well as the slanting direction of the bristle tufts to be slanted on the block head of a toothbrush, the present inventor has achieved the present invention.

SUMMARY OF THE INVENTION

It is therefore an object of the present invention to solve the problems in the prior art toothbrushes as described above.

It is another object of the present invention to provide a toothbrush which is not deteriorated in mechanical and chemical strength.

It is still another object of the present invention to provide a toothbrash which has a high dental plaque removing effect and no fear of hurting the gums.

Other objects of the present invention will be more apparent from the following description.

In order to attain the above objects, the toothbrush according to the present invention is arranged. That is, the present invention provides a toothbrush comprising a block head having bristle tufts implanted therein, at least the whole of bristle tufts outer circumferentially disposed being implanted so as to be inwardly slanted in the direction substantially toward a center of said block head. The area formed by the outer circumference of the tip end portions of the implanted bristle tufts is made smaller than the area formed by the outer circumference of the base and portions of the bristle tufts to thereby make the density of the bristles high at the tip end portions thereof.

In the thus-arranged toothbrush, it has been made possible to make the density of the bristles high at the tip end portions thereof without making the density of the tuft implantation high at the base end portions. Accordingly, it is possible to obtain a high brushing pressure and an improved dental plaque removing effect by the brushing method, such as a scrubbing method, the Fones' method, the Bass method, using the tip end of the bristles, even if the toothbrush using fine or soft bristles is used. It is therefore effective in prevention of the dental caries, periodontosis, and the like. Furthermore, since the soft bristle tufts can be used, there is no fear of hurting gums even if brushing is carried out strongly. Accordingly, brushing can be performed effectively without anxiety.

BRIEF DESCRIPTION OF THE DRAWING

Other features and advantages of the invention will be apparent from the following description taken in connection with the accompanying drawings wherein.

DETALIDED DESCRIPTION OF THE INVENTION

Figure 1:
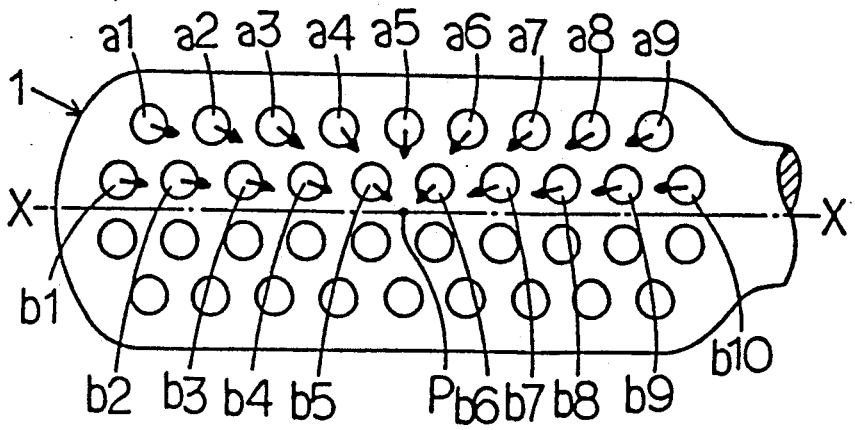
FIG. 1 is an explanatory view showing the state of tuft holes of the toothbrush according to an embodiment of the present invention.

Referring to the drawings, embodiments of the present invention will be described in detail hereunder. FIGS. 1 through 5 are explanatory views showing states of tuft-implantation in various embodiments of the toothbrush according to the present invention. In the drawings, a block head (tuft-implantation part) 1 may be made of, for example, an acrylonitrile-styrene copolymer (AS), an acrylonitrile-butadiene-styrene copolymer (ABS), a polypropylene resin (PP), a cellulose derivative (such as a cellulose propionate), a nylon, a polycarbonate-polyethylene terephthalate copolymer (PC-PET), a polycarbonate-acrylonitrile-butadiene-styrene copolymer (PC-ABS), a polymethyl pentene resin, or an acrylic polymer such as polymethyl methacrylate (PMMA). In the drawings, a first row of tuft holes $a_1$ through $a_9$ and a second row of tuft holes $b_1$ through $b_{10}$ are formed in one half side of the block head 1 with respect to the center line X—X of the block head 1, and two other rows of tuft holes are formed on the other half side of the block head 1 respectively symmetrically with the foregoing first and second rows of tuft holes $a_1$ through $a_9$ and $b_1$ through $b_{10}$ with respect to the center line X—X. Each of the illustrated embodiments describes the case where the bristle tufts are implanted in four rows. However, it is a matter of course that the present invention is not limited to this, and the number of the rows of tuft holes can be settled suitably. Since the bristle tufts are implanted symmetry with respect to the center line X—X, the description will be made only about the upper half portion in each drawing hereinafter.

An arrow illustrated in each of the tuft holes indicates the direction of slanting of the tufts implanted in the tuft hole. To make the each bristle tuft slant in the direction of the arrow, each tuft hole is slanted in the same direction as the arrow from the bottom to the opening of the tuft hole.

The ratio of the area formed by the outer circumference of the tip end portions of the respective bristle tufts (hereinafter referred to as "implanted-tufts tip-end area") to the area formed by the outer circumference of the base end portion (roots) of the respective bristle tufts (hereinafter referred to as "implanted-tufts base-portion area") is preferably in the range of from 60% to 80%.

The area formed by the outer circumference of the base end portion of the respective bristle tufts is preferably in the range of from 1.6 $cm^2$ to 2.8 $cm^2$.

As the material of the bristles implanted in the tuft holes, a nylon, a polyester such as a polyethylene terephthalate (PET), animal hairs such as pig's hairs, a polypropylene (PP), a polyvinylidene chloride may be used. Among these, bristles made of a nylon are preferably used. It is preferred that the length of the bristles is in the range of about from 7 mm to 14 mm for an adult, and in the range of about from 5 mm to 12 mm for a child. The most preferred range of the length of the bristles is from 10 to 11 mm. The diameter of the bristles is preferably in the range of about from 0.15 to 0.25 mm.

In view of the drainage of water, the ratio of the total area of tuft holes to the implanted-tufts base-portion area is preferably 0.45 or less.

FIG. 1 shows a first embodiment in which the outer circumferentially disposed bristle tufts are respectively implanted in the outer circumferentially disposed tuft holes $b_1$, $a_1$ through $a_9$, and $b_{10}$ while gradually changing the slanting direction of the respective bristle tufts so that the slanting direction of each bristle tuft points to the center P of the block head 1. Similarly to this, the inner circumferentially disposed bristle tufts are respectively implanted in the inner circumferentially disposed tuft holes $b_2$ through $b_9$ surrounded by the outer circumferentially disposed tuft holes $b_1$, $a_1$ through $a_9$, and $b_{10}$, while gradually changing the slanting direction of the respective bristle tufts so that the slanting direction of each bristle tuft points to the center P of the block head 1.

As an specific example of the slanting angles of the bristle tufts for satisfying the above-mentioned preferred conditions in an embodiment of the present invention shown in FIG. 1, the respective bristle tufts in the tuft-holes $a_1$, $a_9$, $b_1$ and $b_{10}$ are slanted by 6°, the respective bristle tufts in the tuft-holes $a_2$, $a_6$, $b_4$ and $b_7$ are slanted by 5°, the respective bristle tufts in the tuft-holes $a_3$, $a_7$, $b_3$ and $b_8$ are slanted by 4°, the respective bristle tufts in the tuft-holes $a_4$, $a_6$, $b_4$ and $b_7$ and the respective bristle tufts in the tuft-holes $b_5$ and $b_6$ are slanted by 2°, and the bristle tuft in the tuft-hole $a_5$ is slanted by 3°, in the respective slanting directions indicated by the arrows in FIG. 1.

Figure 2:
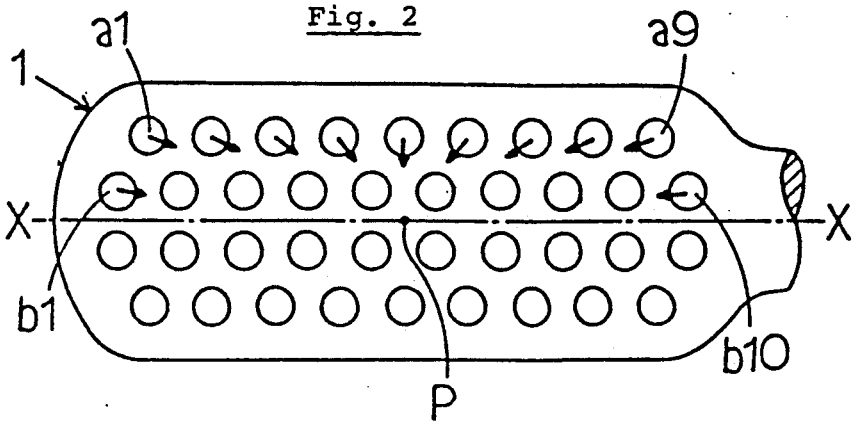
FIGS. 2 through 5 are explanatory views respectively showing the states of tuft holes according to other embodiments of the present invention.

FIG. 2 shows another embodiment of the present invention in which the bristle tufts other than those implanted respectively in the outer circumferential tuft holes $b_1$, $a_1$ through $a_9$, and $b_{10}$ are implanted upright in the same manner as the conventional case.

Figure 3:
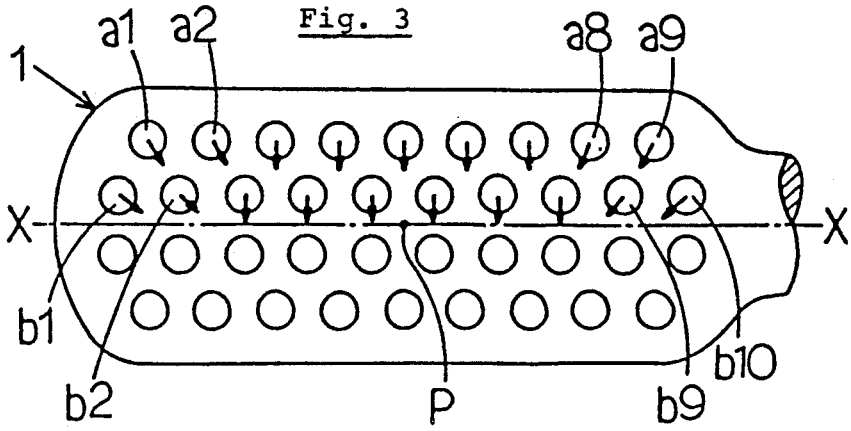

FIG. 3 shows a further embodiment of the present invention in which the bristle tufts illustrated in FIG. 1 are varied in slanting direction such that the respective slanting directions of the bristle tufts implanted respectively in the tuft holes $a_3$ through $a_7$, and $b_8$ are not changed stepwise so as to be made to point to the center P but the whole of those bristle tufts described above are made to point to the center line X—X.

Figure 4:
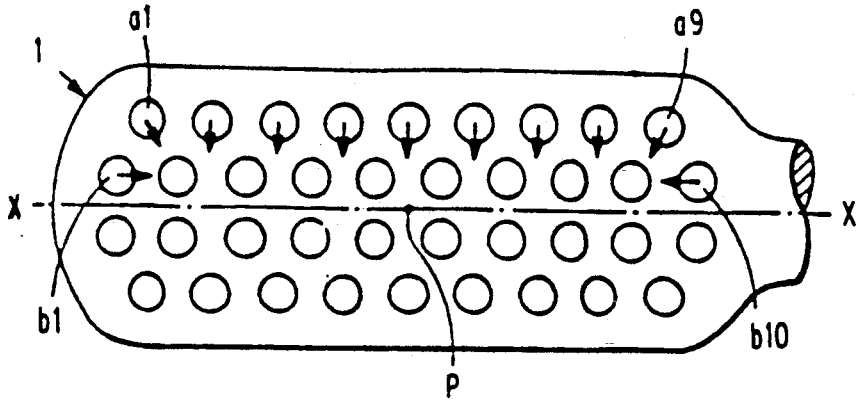

FIG. 4 shows still another embodiment of the present invention in which the bristle tufts implanted respectively in the tuft holes $b_1$ and $b_{10}$ are slanted in the longitudinal direction of the block head and the bristle tufts respectively implanted in the tuft holes $a_2$ through $a_8$ are slanted in the direction toward the center line X—X.

Figure 5:
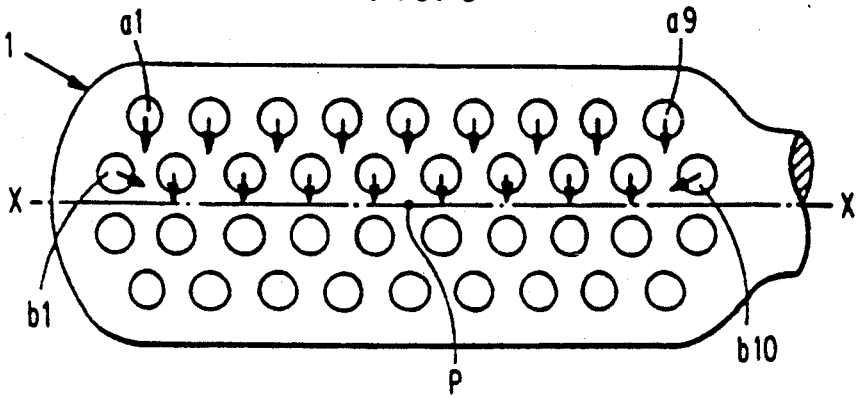

FIG. 5 shows still another embodiment of the present invention in which the whole bristle tufts implanted in the respective tuft holes other than those implanted in the tuft holes $b_1$ and $b_{10}$ are slanted in the direction to the center line X—X.

Other embodiments than those illustrated in FIGS. 1 through 5 may be properly employed as long as at least all the outer circumferentially disposed tufts among the whole tufts implanted in the block head are slanted substantially in the direction toward the center of the block head. The terminology of "the direction substantially toward the center of the block head" used herein includes the direction toward the center line X—X and the inward direction toward the longitudinal direction of the block head, other than the direction toward the center P.

When the brushing method, such as the scrubbing method, the Fone's method, the Bass method, by using the tip end of bristle tufts, is carried out by using the toothbrush according to the present invention, it is possible to obtain a high brushing pressure and a high dental plaque removing effect. Further, since the density of the bristles at the tip end portions of the bristle tufts can be made high without making the bristle tuft-implantation density high at the base portions of the implanted bristle tufts, it is possible to perform brushing with superior brushing feeling and with no fear of hurting gums. Further, when the implanted-tufts tip-end area is reduced, the tuft holes are not necessary to be close to each other at the base portions of the implanted bristle tufts, so that the mechanical strength of the block head is not lowered. Furthermore, water can be drained effectively after used is, so that the toothbrush can be kept clean.

The present invention is now explained in more detail referring to the following examples, but not to be construed as limiting the scope of the present ivention.

EXAMPLE 1

Figure 6A:
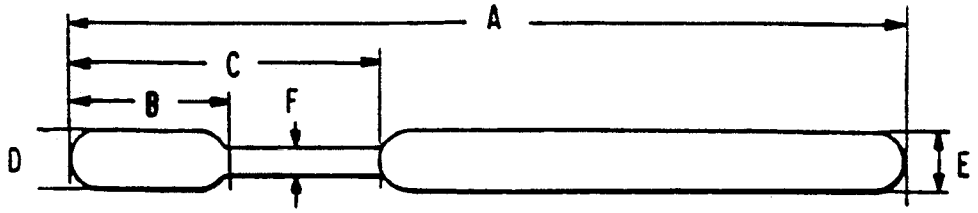
FIGS. 6A and 6B are plan and side views respectively showing the shape of a toothbrush used in the test.
Figure 6B:
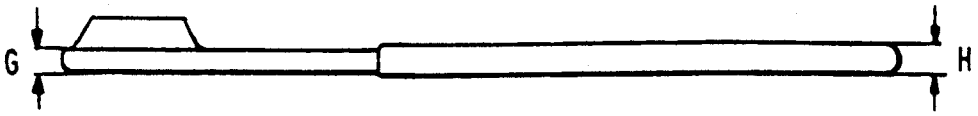

Toothbrush bases as shown in FIG. 6 were prepared by using a polypropylene resin (Noblen JHH-3269 made by Mitsui Toatsu Chemicals Inc.) of which sizes at various parts selected so that A=170 mm, B=32 mm, C=62 mm, D =12 mm, E=13 mm, F=6 mm, G=5 mm and H=6 mm, in which A, B, C, D, E, F, G and H respectively represent the whole length of the toothbrush, the length of the block head, the sum of the respective lengths of the block head and the neck portion, the width of the block head, the width of the block handle, the width of the neck portion, the thickness of the block head and the neck portion the thickness of the block handle. In the block head of each of the thus prepared toothbrush bases, bristle tufts were implanted in such a manner according to the above embodiment shown in FIG. 1 by using 0.20 mm diameter bristles (6,12-Nylon produced by Du Pont (E. I.) de Nemours & Co.), and then the implanted tufts were cut so as to have a length of 11 mm. In the thus obtained toothbrushes, the slanting angle of the bristle tufts was suitably set so as to make the implanted-tufts tip-end area vary, and the relation between the tuft tip-end area and the brushing pressure which would be a base for the judgement of superiority in dental plaque removing effect was measured. In the toothbrushes, the implanted-tufts base-portion area was 2.34 $cm^2$.

The manner of test was defined such that the tip end portions of the implanted bristle tufts of the toothbrush were put onto a pressure sensitive sheet (Prescale Film of the super low pressure type produced by Fuji Photo Film Co., Ltd.), a weight of 700 g was applied onto the back surface of the block head for 30 seconds, the toothbrush was then removed, and the area of colored points generated on the pressure sensitive sheet was measured under a predetermined condition of illumination by using an image processing apparatus with the measurement area being a square of 8 mm×8 mm.

Table 1 shows the results of test. In Table 1, the "area ratio (%)" represents the ratio of the implanted-tufts tip-end area to the implanted-tufts base-portion area, and the "brushing pressure relative value" represents the relative value of pressure based on the brushing pressure of a toothbrush having an area ratio of 100% in which the whole bristle tufts are implanted in the block head perpendicularly to the block head.

TABLE 1

| Area ratio (%) | Relative value of brushing pressure |
|---|---|
| 45 | 0.70 |
| 50 | 0.88 |
| 55 | 0.95 |
| 60 | 1.23 |
| 65 | 1.31 |
| 70 | 1.41 |
| 75 | 1.33 |
| 80 | 1.26 |
| 85 | 1.10 |
| 90 | 1.08 |
| 95 | 1.02 |
| 100 | 1.00 |

It is apparent from results shown in Table 1 that it has been found that the relative value of brushing pressure becomes maximum at the area ratio of 70% and becomes relatively large in the range of from 60% to 80%. There is a tendency that when the area ratio is 85% or more beyond the above-mentioned range, the brushing pressure becomes relatively low because of the low density of the tip end portions of the tufts, while when the ratio is 55% or less, the brushing pressure acting on the tip ends of the bristle tufts becomes low because of the large slanting angle of the tufts. Thus, it has been found that it is preferable to set the slanting angle of the tufts so that the value of the area ratio falls within the range of from 60% to 80%.

EXAMPLE 2

In order to specify a further preferred mode of the block head superior in dental plaque removing effect, the following test was carried out.

In this test, used were toothbrushes which were the same as those used in Example 1 in the mode of the tuft holes as well as in the material, the thickness and the length of the tufts, and in which the area ratios were set within the range of 70%±5% in which the largest brushing pressure was shown in Example 1. The shape of the block head of each toothbrush was set so that A=175 mm, B=40 mm and C=70 mm, in which A, B and C represent the whole length of the toothbrush, the length of the block head, and the sum of the respective lengths of the block head and the neck portion. The implanted-tufts base-portion areas of the respective toothbrushes were stepwise changed in a range of from 1.4 $cm^2$ to 3.0 $cm^2$ and the dental plaque removing effect was measured with respect to each of the implanted-tufts base-portion areas.

The test was carried out by each of five subjects repeatedly for nine weeks with every week as one cycle. Of the nine weeks, every week was allotted for testing one kind of toothbrush, so that nine kinds of toothbrushes different from each other in implanted-tufts base-portion area were used for the test in the repeated nine cycles. The test procedure in every week was determined so that dental plaques and tartar were completely removed in the first day, brushing was carried out by using a soft-bristle toothbrush in each of the second to fourth days so as to allow dental plaques to adhere again to the teeth, brushing was stopped in each of fifth and sixth days, and dental plaque removing test was executed in the seventh day. The reason why the removal of dental plaques and tartar was performed on the first day and thereafter dental plaques were allowed to adhere again onto the teeth by use of soft-bristle toothbrushes was that the influence on the dental plaque removing effect due to the existence of tartar was eliminated so as to make it possible to purely measure only the dental plaque removing effect.

The dental plaque removing test was carried out in a manner so that the dental plaque adhering amount R was measured after stopping brushing by the soft-bristle toothbrushes, then brushing was made to remove dental plaques by using a toothbrush to be tested, and the dental plaque adhering amount S after the brushing was measured. An expression of $(R-S)/R \times 100$ was used to obtain the dental plaque removing rate (%).

Table 2 shows the kinds of toothbrushes used by the five subjects and the numerical values in the columns of the Table 2 represent the implanted-tufts base portion areas ($cm^2$). Table 3 shows the results of the executed test including the dental plaque removing rate for each toothbrush for every subject and the average of the dental plaque removing rate for every toothbrush.

TABLE 2

| | Inplanted-tufts base portion area ($cm^2$) | | | | | | | | |
|---|---|---|---|---|---|---|---|---|---|
| | Week | | | | | | | | |
| Subjects | 1 | 2 | 3 | 4 | 5 | 6 | 7 | 8 | 9 |
| 1 | 1.4 | 1.5 | 1.6 | 1.8 | 2.2 | 2.6 | 2.8 | 2.9 | 3.0 |
| 2 | 1.6 | 1.8 | 2.2 | 2.6 | 2.8 | 2.9 | 3.0 | 1.4 | 1.5 |
| 3 | 2.2 | 2.6 | 2.8 | 2.9 | 3.0 | 1.4 | 1.5 | 1.6 | 1.8 |
| 4 | 2.8 | 2.9 | 3.0 | 1.4 | 1.5 | 1.6 | 1.8 | 2.2 | 2.6 |
| 5 | 3.0 | 1.4 | 1.5 | 1.6 | 1.8 | 2.2 | 2.6 | 2.8 | 2.9 |

TABLE 3

| | Dental plaque removing rate (%) | | | | | | | | |
|---|---|---|---|---|---|---|---|---|---|
| | Base-portion area of tufts ($cm^2$) | | | | | | | | |
| Subjects | 1.4 | 1.5 | 1.6 | 1.8 | 2.2 | 2.6 | 2.8 | 2.9 | 3.0 |
| 1 | 69 | 78 | 84 | 89 | 94 | 96 | 85 | 73 | 68 |
| 2 | 70 | 77 | 86 | 91 | 95 | 97 | 86 | 74 | 71 |
| 3 | 68 | 76 | 82 | 87 | 88 | 93 | 83 | 74 | 69 |
| 4 | 73 | 80 | 89 | 83 | 90 | 94 | 81 | 78 | 74 |
| 5 | 72 | 79 | 86 | 92 | 92 | 95 | 86 | 74 | 70 |
| average | 70.4 | 78.0 | 85.4 | 88.4 | 91.8 | 95.0 | 84.2 | 74.6 | 70.4 |

It is apparent from the results shown in Table 3 that the dental plaque removing rate becomes extremely superior to 95% when the implanted-tufts base-portion area is 2.6 $cm^2$, and that an effective dental plaque removing effect in practical use is obtained when the implanted-tufts base-portion area is set to a value within a range of from 1.6 $cm^2$ to 2.8 $cm^2$.

EXAMPLE 3

The dental plaque removing effect of the toothbrash of the present invention was investigated by the following test.

By using a toothbrash having an implanted-tufts base-portion area of 2.6 $cm^2$ and an area ratio of 70% according to the present toothbrash having a base-portion area of 2.6 $cm^2$ and an area ratio of 100% as a comparative sample, the dental plaque removing effect was evaluated in the same manner as in Example 2. The results obtained are shown in Table 4 below.

TABLE 4

| | Dental plaque removing rate (%) | |
|---|---|---|
| | Area ratio (%) | |
| Subjects | 70 | 100 |
| 1 | 96 | 77 |
| 2 | 97 | 73 |
| 3 | 93 | 68 |
| 4 | 94 | 69 |
| 5 | 95 | 70 |
| average | 95.0 | 71.4 |

It is apparent from the results shown in Table 4 that the toothbrash of the present invention is excellent in dental plaque removing effect in comparison to the conventional toothbrash.

As described above, the toothbrush of the present invention is superior in dental plaque removing effect, and in the case where the tuft holes, for example, as illustrated in FIG. 1, it has been found that the most superior dental plaque removing effect can be obtained when the area ratio is in the range of from 60% to 80% and the implanted-tufts base-portion area is in the range of from 1.6 $cm^2$ to 2.8 $cm^2$. The results of the above mentioned test show the values with respect to the tuft holes illustrated in FIG. 1, however, it can be presumed that the same effect as above can be obtained in other embodiments, for example, in the case of tuft holes respectively shown in FIGS. 2 through 5.

Since the toothbrush of the present invention is arranged such that at least the whole of outer circumferentially disposed bristle tufts are implanted in the block head so as to be inwardly slanted in the direction substantially toward the center of the block head, it is possible to make the bristles density high at the tip end portions of the bristle tufts without making the tuft-implantation density high at the base end portions of the bristle tufts, and a superior brushing pressure can be realized even in the case where fine or soft bristles are used. Accordingly, if the brushing method, such as the Fones' method, the Bass method, by use of tip end of bristle tufts, is carried out by using the toothbrush of the present invention, it is possible to remove dental plaque or other foreign matters effectively without hurting gums, and it is effective to prevent the dental caries, periodontosis, and the like.

While the invention has been described in detail and with reference to specific examples thereof, it will be apparent to one skilled in the art that various changes and modifications can be made therein without departing from the spirit and scope thereof.

What is claimed is:

1. A toothbrush comprising a block head having bristle tufts implanted therein, wherein at least the bristle tufts which define the outer perimeter of all the implanted bristle tufts are implanted so as to be inwardly slanted in the direction substantially toward the center of said block head, and the ratio of an area bounded by an outer circumference delineated by the tip end portions of said implanted bristle tufts to an area bounded by an outer circumference delineated by the base end portions of said implanted bristle tufts is in the range of from 60% to 80%.

2. A toothbrush as claimed in claim 1, wherein the area bounded by the outer circumference delineated by the base end portions of said implanted tufts is in the range of from 1.6 $cm^2$to 2.8 $cm^2$.

3. A toothbrush as claimed in claim 1, wherein the length of said bristles is in the range of from 10 mm to 11 mm.

4. A toothbrush as claimed in claim 1, wherein the diameter of said bristles is in the range of from 0.15 mm to 0.25 mm.

5. A toothbrush as claimed in claim 1, wherein the ratio of the total area of tuft holes in which said tufts are implanted to the area bounded by the outer circumference delineated by the base end portion of said implanted tufts is 0.45 or less.

6. A toothbrush as claimed in claim 1, wherein said blockhead having bristle tufts implanted therein is flat, and a brushing surface formed by tip-end portions of the bristle tufts is substantially flat.

* * * * *